United States Patent [19]

Yengst

[11] Patent Number: 4,715,283

[45] Date of Patent: Dec. 29, 1987

[54] GUIDED MISSILE

[75] Inventor: William C. Yengst, Solana Beach, Calif.

[73] Assignee: Science Applications International Corporation, San Diego, Calif.

[21] Appl. No.: 932,227

[22] Filed: Nov. 18, 1986

[51] Int. Cl.[4] ..... F42B 23/24; F42B 25/20

[52] U.S. Cl. ..... 102/401; 89/1.11; 102/384; 244/3.1

[58] Field of Search ..... 244/3.15, 3.16, 3.19, 244/3.1; 102/382, 384, 211, 212, 401, 427; 89/1.11

[56] References Cited

U.S. PATENT DOCUMENTS

| | | | |
|---|---|---|---|
| 2,959,126 | 11/1960 | Woodward, Jr. et al. | 102/427 |
| 4,090,446 | 5/1978 | Tomasetti | 102/401 |
| 4,637,313 | 1/1987 | Henderson et al. | 102/382 |

OTHER PUBLICATIONS

Dostal, George C.; "Flight Evaluation of MLU-10/B (MA-) Mine"; Sep. 1960.

Sodoma, William C.; "Experimental MLU-10/B Land Mine Impact Test"; Dec. 1964.

*Primary Examiner*—Charles T. Jordan

*Attorney, Agent, or Firm*—Ellsworth R. Roston; Charles H. Schwartz

[57] ABSTRACT

A guided missile is directed to railroad tracks, is buried a particular distance, such as five (5) feet, below the tracks upon reaching the tracks and is covered by rocks in the railroad bed as it moves the particular distance below the tracks. The guided missile detonates when the train approaches on the tracks within a particular distance from the guided missile on the tracks. The train then becomes derailed. The guided missile has a housing which is made from a strong metal and which is relatively thick. Preferably the metal is steel and has a thickness of about 0.2". A nose cone having a blunt configuration is disposed on the housing at the front end of the housing and is made from a material which passes signals into and out of the housing. The material is compressible (e.g. fiberglass, a ceramic or a glass) to become flattened when the missile strikes the ground. A bulkhead preferably having a greater thickness than the housing is disposed in the housing at an intermediate position along the housing length. The bulkhead may be made from the same material as the housing. A seeker including an antenna is disposed in the housing between the nose cone and the bulkhead to transmit signals to the tracks and receive information from the tracks. A warhead is disposed within the housing on the opposite side of the bulkhead from the nose cone. A fuse is disposed within the housing at the rear of the housing to detonate the warhead when the train approaches the missile on the tracks.

9 Claims, 5 Drawing Figures

FIG. 1
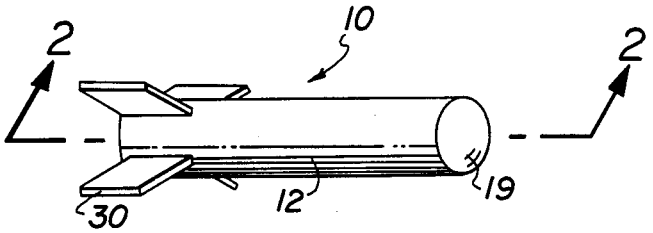
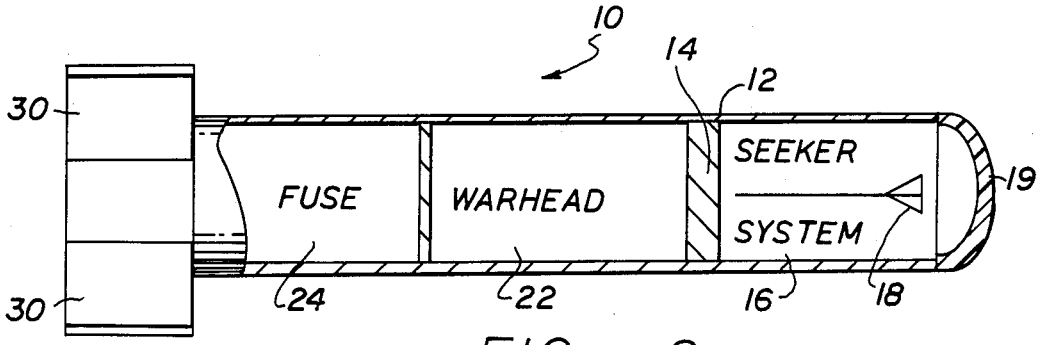
FIG. 2
FIG. 3
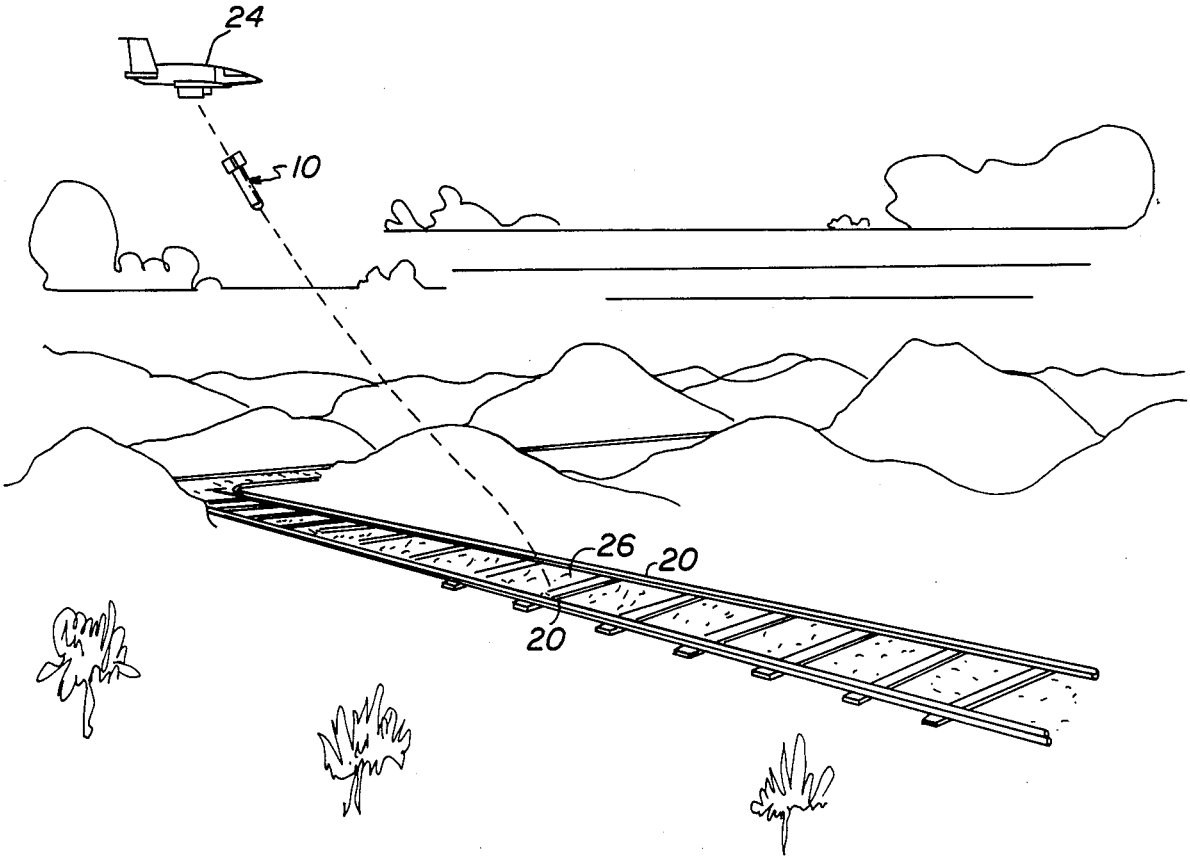

FIG. 4
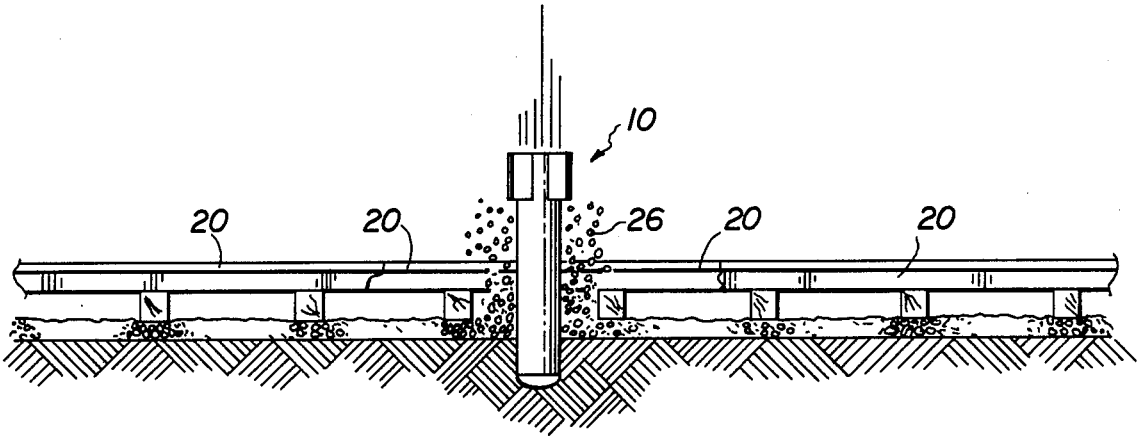
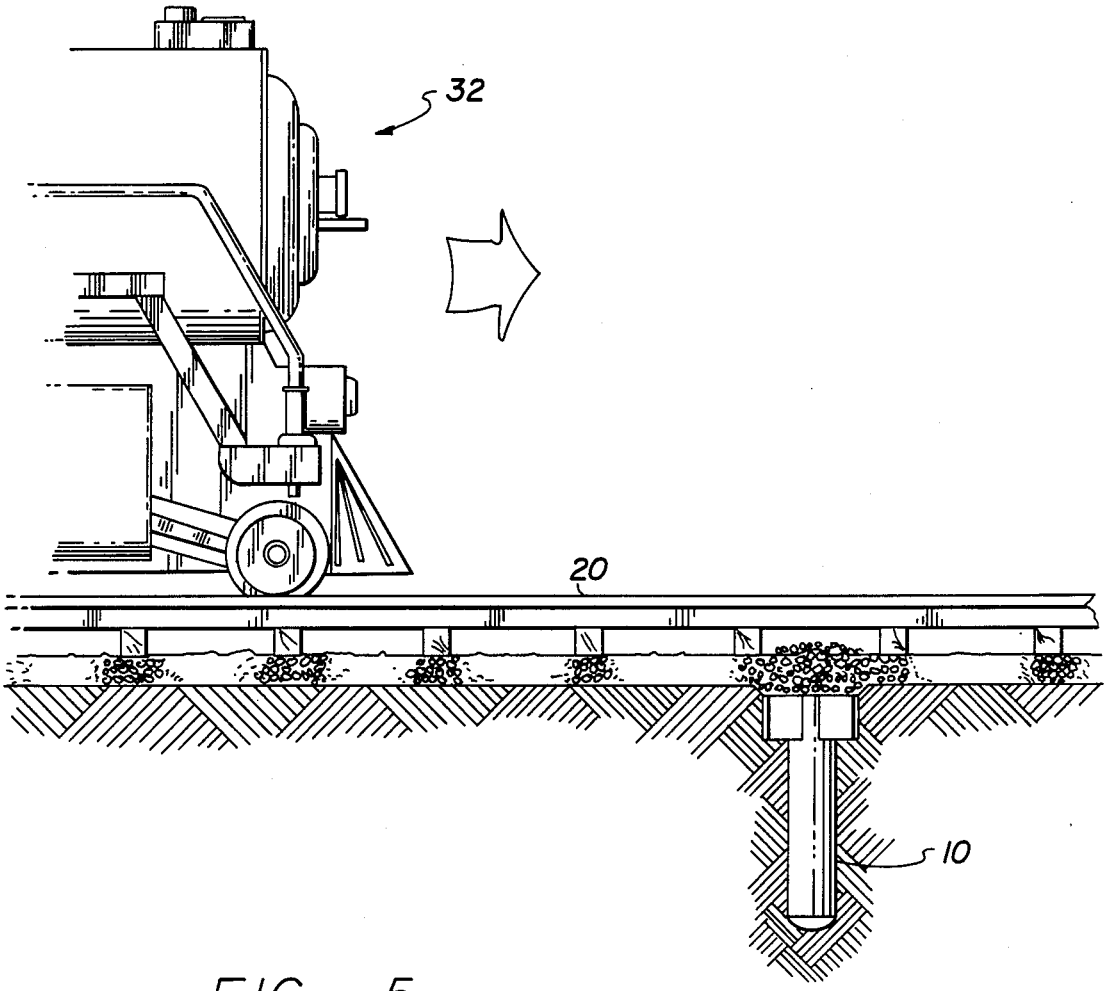
FIG. 5

GUIDED MISSILE

This invention relates to guided missiles. More particularly, the invention relates to guided missiles which are directed to railroad tracks and which remain buried under the tracks without detonation until a train moving on the tracks approaches the guided missile.

Many countries do not have an elaborate network of highways such as have been constructed in the United States in the last twenty (20) or thirty (30) years. These countries rely upon their railroads to transport men and materials to different parts of such countries. Actually, even with the vast highway system in use in the United States, the railroads are important in transporting heavy and bulky equipment throughout the United States.

As will be seen from the discussion in the previous paragraph, railroads in each country play an important part in transporting equipment throughout the country. This is particularly true during periods of war since such war materiel generally has to be transported quickly, often to terminals which may be considered to be out of the way of the major metropolises in the country.

In view of the above, it would be important in time of war to be able to bomb railroad tracks in an enemy country to disrupt the flow of important war materiel throughout such country. However, if the bombing of the railroad tracks occurred openly from the air, the enemy could repair such railroad tracks before a railroad train reached such tracks.

A preferable way of damaging or destroying railroad tracks would be to plant under the tracks a bomb which would not detonate until a train moving on the tracks approached the position of the bomb. However, in order for such a bomb to be effective, the bomb should not be visible to an approaching train or to a person who may be inspecting the tracks. Furthermore, the bomb should be disposed a particular distance, such as approximately five (5) feet, below the train bed in order to have optimum effectiveness.

As will be appreciated, it is not easy to locate in enemy territory a bomb which will be disposed between a pair of tracks a particular distance under the tracks in such a way that it will not be visible from the train bed and will still be effective in derailing a train as the train approaches the position of the bomb. A considerable effort has been made for a long time, and significant amounts of money have been expended, to develop a guided missile which meets these capabilities. In spite of such efforts and such money expenditures, a satisfactory system has not as yet been conceived or developed.

In one embodiment of the invention, a guided missile is directed to railroad tracks, is buried a particular distance, such as five (5) feet, below the tracks upon reaching the tracks and is covered by rocks in the railroad bed as it moves the particular distance below the tracks. The guided missile detonates when the train approaches on the tracks within a particular distance from the guided missile under the tracks. The train then becomes derailed.

The guided missile of this invention has a housing which is made from a strong metal and which is relatively thick. Preferably the metal is steel and has a thickness of about 0.2". A nose cone having a blunt configuration is disposed on the housing at the front end of the housing and is made from a material which passes signals into and out of the housing. The material is compressible (e.g. fiberglass, a ceramic or glass) to become flattened when the missile strikes the ground. A bulkhead preferably having a greater thickness than the housing is disposed in the housing at an intermediate position along the length of the housing. The bulkhead may be made from the same material as the housing.

A seeker including an antenna is disposed in the housing between the nose cone and the bulkhead to transmit signals to the tracks and receive information from the tracks. A warhead is disposed within the housing on the opposite side of the bulkhead from the nose cone. A fuse is disposed within the housing at the rear of the housing to detonate the warhead when the train approaches the missile under the tracks.

In the drawings:

FIG. 1 is a perspective view of a guided missile constituting one embodiment of the invention;

FIG. 2 is a sectional view substantially on the line 2—2 of FIG. 1 and illustrates the guided missile in additional detail;

FIG. 3 is a schematic perspective view illustrating the launching from an airplane of the guided missile shown in FIGS. 1 and 2 and the guided movement of the missile to a position between or near to a pair of railroad tracks;

FIG. 4 is a schematic view illustrating the movement of the missile into the railroad bed between or near the pair of railroad tracks; and FIG. 5 is a schematic view illustrating the final disposition of the missile below the railroad bed to damage the adjacent railroad tracks when a train moving along the railroad tracks approaches the missile position.

In the embodiment of the invention shown in the drawings, a guided missile generally indicated at 10 is provided. The guided missile 10 includes a housing 12 made from a suitable metal such as steel. Preferably the housing 12 has a thickness of approximately two tenths of an inch (0.2") to three tenths of an inch (0.3"). The housing 12 is preferably cylindrical and preferably has a length of approximately thirty inches (30") and a diameter of approximately three to four inches (3"–4"). The weight of the guided missile 10 may be about fourty to fifty pounds (40–50 lb.).

The housing 12 has a bulkhead 14 about ten inches (10") from the front of the housing. The bulkhead 14 may be made from the same metal as the peripheral wall of the housing 12 and may be provided with a thickness materially greater than the thickness of the housing. For example, the thickness of the bulkhead 14 may be approximately half to one inch (0.5"–1").

A seeker system 16 is disposed in the housing 12 forwardly of the bulkhead 14. The seeker system 16 may be constructed in a conventional manner. For example, suitable seekers may constitute the Hughes DARPA Sponsored Tank Breaker Staring Array Infrared Seeker, the Hughes Wasp Millimeter Wave Radar Seeker and the British (Marconi) Anti-Tank Millimeter Wave Radar Seeker. The two Hughes seekers are provided by the Hughes Aircraft Company of Culver City, Calif., and the third seeker is provided by the British Marconi Company.

An antenna 18 may be disposed in the housing 12 at a forward position relative to the seeker system 16. The antenna 18 may be constructed in a conventional manner. The antenna 18 may be provided with characteristics to transmit to railroad tracks 20 signals produced by the seeker system 16 and to introduce to the seeker system signals reflected by the railroad tracks and received by the antenna. A nose cone 19 covers the antenna 18 at the forward end of the housing 12. The nose cone 19 may be made from a suitable material such as a fiberglass, a ceramic or a glass (quartz). The nose cone 19 preferably projects about two inches (2") from the front end of the housing 12. The material of the nose cone 19 has the property of being squashed when the missile 10 is impacted on the railroad bed between or near the railroad tracks 20. The nose cone 19 may be made in a conventional manner well known in the art.

A warhead 22 is disposed in the housing 12 at an intermediate position in the housing 12. The warhead 22 is disposed in the housing 12 adjacent the opposite surface of the bulkhead 14 from the seeker system 16. Preferably the warhead is adjacent the surface of the bulkhead 14. The warhead 22 may be made from any suitable explosive. For example, 10 to 20 pounds of TNT will cause sufficient damage to derail a train if the explosive is within about 5 feet of the tracks.

A fuse 24 is disposed within the housing 12 at the rear end of the housing. The fuse 24 may be constructed in a conventional manner to respond to the approach of a heavy metallic object made from a suitable magnetizable material such as a train. The fuse may be sensitive to acoustic, siesmic, or pressure signals from the train. For example, the fuse 24 may be constructed in accordance with any of the following publications:

(a) "Flight Evaluation of MLU-10/B (MA-1) Mine" by Captain George C. Dostal, U.S. Air Force, Air Proving Ground Center, Eglin Air Force Base, Florida (b) Experimental MLU-10/B Land Mine Impact Test by Captain Wilfred C. Sodoma, U.S. Air Force, Eglin Air Force Base, Florida in December 1964.

The fuse is constructed to detonate the warhead 22 when the fuse becomes activated.

It will be appreciated that the guided missile 10 is shown only schematically in the drawings and that other components may be included in the guided missile. For example, the guided missile may be provided with tail fins 30 to facilitate the movement of the missile in a controlled course toward the railroad tracks 20 when the missile has been lauched from an aircraft or other suitable delivery platform (e.g., cruise missile, remotely controlled vehicle, or ballistic missile). The construction of such features as the tail fins 30 are well known in the prior art.

The guided missile 10 may be launched from an aircraft 24 which preferably delivers the missile to a position about one (1) mile from the railroad tracks 20 and at a height of several thousand feet above the railroad tracks. When the guided missile 10 is launched, the seeker 16 and the antenna 18 operate to home the missile on the railroad tracks 20. Preferably the railroad tracks 20 are disposed in open country since this simplifies the process of locating the tracks and performing the homing capabilities of the guided missile.

The seeker system 16 and the antenna 18 are sufficiently sophisticated to have the missile 10 enter the bed 26 of the railroad tracks 20 at a position between or near the tracks (i.e., within about 5 feet). The bed 26 is formed from relatively small rocks. As the missile 10 enters the railroad bed 26, these relatively small rocks become moved laterally and vertically to create a bomb crater. However, the bomb crater becomes filled above the guided missile 10 as the missile moves into the ground below the railroad bed. This results from the loose nature of the small rocks covering the railroad bed. In this way, the crater becomes substantially covered so that an inspector moving along the tracks, or an engineer of an on-coming train, cannot easily detect that the missile 10 is disposed below the railroad bed.

As the missile 10 moves into the ground below the railroad bed 26, its kinetic energy becomes dissipated in several different ways. One way is from the movement of the rocks away from the missile to create temporarily a crater around the missile. Another way is that the nose cone 19 becomes flattened. A further way is by the friction of the missile against the track bed 26 and the earth below the track bed as the missile moves through the track bed and the earth below the track bed. An additional way is that the missile has to move the earth aside as it moves through the earth.

As a result of such dissipations of energy and as a result of the parameters (e.g., weight, diameter, length, etc.) chosen for the missle 10, the missile moves only for a distance such as five feet (5') or six feet (6') below the earth's surface. This distance is sufficiently deep for the rocks in the rock bed 26 to cover the missile. However, this distance is sufficiently shallow for the missile to damage the railroad tracks when the warhead 22 is detonated. By providing for the movement of the missile only the selected distance into the earth below the railroad bed 26, the amount of the explosive material in the warhead 22 can be minimized. This in turn minimizes the size and weight of the missile and the amount of energy which has to be expended to move the missile 10 the selected distance into the earth below the railroad bed 26.

Since the housing 12 envelopes the seeker 16, it protects the seeker as the guided missile 10 moves through the railroad bed 26 and the earth below the rock bed. This prevents isolated components in the seeker 16 from becoming separated from the missile 10. It would be undesirable to allow isolated components in the seeker 16 from becoming separated from the missile 10 because at least some of these isolated components would tend to remain on the surface of the railroad bed 26 and provide tell-tale visual indications to an inspector or a train engineer that a missile is located below the surface of the railroad bed.

As a railroad train 32 approaches the position where the guided missile 10 is buried below the railroad bed 26, it causes the fuse 24 to be activated in a manner well known to the prior art. This in turn produces an explosion of the warhead 22. The warhead 22 may not be sufficiently large to damage or destroy the train. However, the warhead 22 is sufficiently large to damage or destroy the railroad tracks 20 at the position above the missile 10 so that the train becomes derailed as it reaches the position where the tracks have been damaged or destroyed. Derailing the train may actually be more effective than destroying the train since it requires a considerable effort to repair the tracks and the train or to move the train back into proper position on the tracks.

In addition to the advantages inherent in the operation of the guided missile 10 as discussed above, the guided missile has other important advantages. For example, the guided missile 10 cannot be easily detected even by a metal detector. This results from the fact that the guided missile 10 is disposed between or near the railroad tracks 20, which are also metallic. As a result, the railroad tracks 20 mask any attempt to detect the missile 10 as by a metal detector.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination in a guided missile for directing the guided missile to railroad tracks and for providing for the disposition of the missile under a railroad bed beneath the tracks to derail an approaching train, a housing made from a thick and strong metal, the housing having a blunt nose made from a compressible material, the housing having a relatively thick bulkhead at an intermediate position along the length of the housing, a seeker system in the housing between the bulkhead and the nose for homing the guided missile on the railroad tracks, a warhead in the housing at an intermediate position in the housing, and a fuse in the housing at a rearward position in the housing.

2. In a combination as set forth in claim 1, the housing being made from steel and the nose being defined by a nose cone made from a plastic material with properties of passing signals from the seeker system for transmission to the railroad tracks and for introducing to the seeker system signals reflected from the railroad tracks.

3. In a combination as set forth in claim 2, the bulkhead in the housing being thicker than the wall defining the periphery of the housing.

4. In a combination as set forth in claim 3, the fuse having properties of detonating the warhead only when trains moving on the tracks approach the guided missile in the position of the guided missile beneath the railroad tracks.

5. In combination in a guided missile for directing the guided missile to railroad tracks and for providing for the disposition of the missile under a railroad bed between the tracks to derail an approaching train, a housing defining the periphery of the guided missile and made from a metal having a thickness of at least two tenths of an inch (0.2″) and having properties of withstanding the impact of the missile with the railroad bed between the tracks, a bulkhead made from the same metal as the housing and having a thickness greater than the thickness of the housing, the bulkhead being disposed in the housing at an intermediate position along the length of the housing, a nose cone disposed at the forward end of the housing and having a blunt configuration and having properties of passing through the bulkhead signals transmitted by the guided missile toward the railroad tracks and signals reflected by the railroad tracks toward the guided missile, the nose cone being constructed to become flattened upon impinging on the railroad bed between the tracks, a seeker disposed in the housing between the cone and the bulkhead and constructed to produce the signals for transmission through the nose cone toward the railroad tracks and to process the signals reflected from the railroad tracks, a warhead disposed in the housing at the opposite side of the bulkhead from the nose cone, and a fuse disposed in the housing rearwardly of the warhead.

6. In combination in a missile as set forth in claim 5, an antenna included in the seeker and disposed in the housing at a position adjacent the nose cone.

7. In a combination as set forth in claim 6, the projectile having tail fins at the rear end of the housing to stabilize the guided missile and provide for a direction of the guided missile toward the railroad tracks.

8. In a combination as set forth in claim 7, the housing and the bulkhead being made from a steel and the nose cone being made of material selected from the group consisting of a fiberglass, a ceramic and a glass.

9. In a combination as set forth in claim 7, the housing having a thickness of at least two tenths inch (0.2″) and the bulkhead having a thickness of about one half to one inch (0.5″–1″).

* * * * *